US007165484B2

(12) United States Patent
Wang

(10) Patent No.: US 7,165,484 B2
(45) Date of Patent: Jan. 23, 2007

(54) BLAST-RESISTANT CARGO CONTAINER

(75) Inventor: Ming-Jong Wang, Taoyuan Hsien (TW)

(73) Assignee: Industrial Technology Research Institute (TW)

( * ) Notice: Subject to any disclaimer, the term of this patent is extended or adjusted under 35 U.S.C. 154(b) by 296 days.

(21) Appl. No.: 10/826,640

(22) Filed: Apr. 15, 2004

(65) Prior Publication Data

US 2004/0194614 A1 Oct. 7, 2004

Related U.S. Application Data

(63) Continuation-in-part of application No. 10/236,621, filed on Sep. 5, 2002, now abandoned.

(51) Int. Cl.
*F42B 33/06* (2006.01)
*B65D 51/00* (2006.01)

(52) U.S. Cl. ..... 86/50; 220/840

(58) Field of Classification Search ..... 86/50; 206/3; 220/840, 842, 667, 309, 324, 810–812
See application file for complete search history.

(56) References Cited

U.S. PATENT DOCUMENTS 2,527,318 A * 10/1950 Finn ..... 220/832
2,677,479 A * 5/1954 Kiba ..... 220/840
2,868,360 A * 1/1959 Donkin ..... 206/3
3,598,273 A * 8/1971 Rau et al. ..... 220/1.5
4,727,789 A * 3/1988 Katsanis et al. ..... 86/50
5,195,701 A 3/1993 Willan ..... 224/118.1
5,267,665 A * 12/1993 Sanai et al. ..... 220/88.1
5,497,895 A 3/1996 Rudbach ..... 220/4.33
5,597,084 A * 1/1997 Parasin ..... 220/4.28
5,654,053 A * 8/1997 Crane et al. ..... 428/36.5
5,769,257 A 6/1998 Fleisher et al. ..... 220/1.5
5,833,782 A * 11/1998 Crane et al. ..... 156/60
6,089,398 A 7/2000 Weinstein ..... 220/324
6,196,107 B1 3/2001 Hoffman et al. ..... 86/50
6,237,793 B1 5/2001 Fingerhut et al. ..... 220/1.5
6,918,501 B1 * 7/2005 Wang et al. ..... 220/1.5
7,004,344 B1 * 2/2006 Fulton et al. ..... 220/4.31

* cited by examiner

*Primary Examiner*—Michael J. Carone
*Assistant Examiner*—Bret Hayes
(74) *Attorney, Agent, or Firm*—Tai E. International Patent & Law Offices; James A. Fox, Esq.

(57) ABSTRACT

A blast-resistant cargo container includes side panels and connecting members. The connecting members are mounted between the adjacent side panels to create a frameless structure of the cargo container. Under ordinary conditions, the structure still has sufficient stiffness for loading goods. When an explosive blast occurs in the cargo container, the structure is flexible and utilizes membrane strength in the entire container structure, whereby the cargo container is capable of withstanding the explosive blast. Bottom perimeter bars are able to be mounted around a bottom surface of the cargo container. Grooves are defined in the perimeter bars and L-shaped flanges are formed on one end of the connecting members. Therefore, by receiving the L-shaped flanges into the grooves, the perimeter bars are securely connected with the side panels.

19 Claims, 14 Drawing Sheets

BLAST-RESISTANT CARGO CONTAINER

CROSS REFERENCE

The present invention is a continuation-in-part (CIP) of the application Ser. No. 10/236,621, filed on Sep. 5, 2002, now abandoned, by the same applicant of the present invention. The content thereof is incorporated for reference hereinafter.

BACKGROUND OF THE INVENTIONS

1. Field of the Invention

The present invention relates generally to cargo containers, and more particularly concerns a blast-resistant cargo container that is capable of substantially confining an explosive blast within the cargo container for protecting a carrier such as an airplane.

2. Description of Related Art

Conventional cargo containers are typically designed to have a frame, and panels attached to the frame so as to define a chamber interior for receiving goods. There are many kinds of available cargo containers having different sizes and configurations in order to meet practical needs, wherein an air cargo container is a kind to be used for transporting goods via an airplane.

Recently, airplanes have become a primary target for terrorist attacks, and many people have lost their lives in plane crashes due to terrorist bombing. Therefore, the Federal Aviation Administration (FAA) and major airline companies all over the world are forced to enhance security checks at the Custom of an airport in order to prevent explosives being smuggled on board. However, small plastic explosives are difficult to be detected despite current technology and are very likely to pass through the security checks. In the tragedies of Pan Am103 1998 and UTA Flight 772 1989, the explosives were smuggled on board the jets and caused plane crashes that resulted in loss of hundreds of lives and properties. Therefore, to prevent these kinds of tragedies from happening, a lot of efforts have been made in the field of blast-resistant containers.

According to analysis and experiment research, an explosive blast destroys the cargo container in two stages. In the first stage, shock waves are generated and impact the cargo container in a short duration. In the second stage, the succeeding much longer, more uniform and much lower magnitude explosive pressure exerts on the cargo container. The failures of both these two stages must be countered so as to make a container blast-resistant. During the moment of the explosion, the pressure at the center of the blast can be hundreds of thousands times of atmospheric pressure. Fortunately, the very great shock pressure is not definitely to cause structural failure in general due to it being very short duration and being a very local loading to a container. With the fast propagation and rapid decay of the shock waves, the ensuing pressure exerted on the panels is still no less than several ten times of the atmospheric pressure. With reflection and diffraction of the waves, the pressure becomes steady and its magnitude is much less than the shock waves. However, the pressure is still tens times greater than the payload of the conventional cargo container. Therefore, the conventional cargo container as shown in FIG. 14 is vulnerable to the explosive blast.

In order to overcome the mentioned problems, several blast resistant techniques are applied to the air cargo container. The first category utilizes the venting method, such as found in U.S. Pat. No. 5,195,701, wherein an explosive propels the venting device to pierce the wall of the fuselage of an airplane and this allows venting of the shock waves and high pressure to the exterior of airplane. For that it supposed to resist so high pressure (the pressure of shock wave may exceed one million pounds per square inches) is impractical. So that the high blast pressure is thus vented in a controlled manner outside the air cargo container to prevent a total destruction. Nevertheless, the high blast pressure and its carrying broken materials with high kinetic energy are still possible to puncture the fuselage wall of the airplane ultimately and this results in a crash. Although puncturing a wall may not usually be serious enough to cause a crash, damage to the airplane is still very costly to repair, and the time that the airplane is grounded is very expensive in lost income. Therefore, it is considered to be impractical to use the venting method to deal with the explosive blasts.

The second category utilizes the rigid confining method. With reference to FIG. 14, an air cargo container (40) designed according to this method is shown and has a rigid frame (41). Panels (42) made of energy-absorbing material are mounted onto the frame (41). The panels (42) must be inordinately thick enough so as that the wall can absorb destroying energy and to withstand the pressure of the explosive blast, and to further confine the pressure inside the air cargo container (40). However, in practice, what really destroys the structure of the air cargo container (40) is high stress, and high energy is not definitely the important factor for that it doesn't always induce high stress in a structure system. Increasing the thickness of the panels (42) not only increases the cost, but also increases bending stress when encountering a blast inside the container. As a result, the increasing in the weight of the container is not acceptable by the aviation industry because the weight increase of the container means a lot more expenses will thus be incurred. Therefore, in order to overcome the high stress, the air cargo container (40) has to be constructed so heavily that it is not feasible to be carried by the airplane.

Based on more detail studies of a container structure we also found: Even though the container panels are made of high strength materials, if the structure is not adapted, the panels and their edges nearby can be damaged by the explosive blast. I.e., even there are high strength materials for panels, if there is no appropriate structure layout to make the structure stress redistribution in the edges nearby during blast loading, the pressure from explosion inside the cargo container will generate tremendous bending stress on the container edges and causes serious destruction.

U.S. Pat. No. 6,237,793 basing on the similar recognition: "the seams along the frame where the panels are connected are typically the weakest point of the container in an explosion", it used flexible (cloth) panels to wrap the rigid frames to form a light weight blast-resistant air cargo container. In this patent, a rather rigid frame system offers the stiffness of the container for operation of loading/unloading goods as usual and the very flexible panels, which are cloth made of high strength and light weight composites and never induce great bending stress, can deform to a spherical-like shape and take the great pressure under a blast. But it is not an idea choice for a cargo container with too flexible side panels in general.

The explosive containment device of U.S. Pat. No. 6,196,107 is originated from the conventional bomb containment vessel, which is spherical or cylindrical shell made of steel, and is a box-like shell having flat side panels and their transition portion (edges). So that it is a frameless design. In this patent, the entire continuous shell made of ductile material (steel) can be plastically deformed greatly and can take the great pressure under a blast. But it is too heavy (several times greater than light weight blast-resistant air cargo container, mainly due to its high density metal material) and absent the space to be put many packages for real use. The bending stiffness of this structure in the edge nearby is too great to deform fully to a spherical-like shape in general. There are no mechanisms to vary the bending stiffness in the edge nearby and replace light weight side panels.

SUMMARY OF THE INVENTION

"How to relieve much too great bending stress in the edges nearby under a blast" is the fundamental key problem of a light weight blast-resistant cargo container. Based on the concept of a frameless design, "how to vary or control the bending stiffness of the structure in the edge nearby" is another key problem. The present invention offers a simple answer: we just need to distinguish the edges as the connecting members and separate them from side panels to consider their requirements or characteristics totally different.

An objective of the present invention is to provide a frameless blast-resistant cargo container with light weight. Under ordinary conditions, the structure has sufficient stiffness for loading goods. When an explosive blast occurs in the cargo container, the structure is sufficiently flexible to deform to spherical-like shape from original box-like shape and can almost fully utilize the membrane strength of the material in the entire structure, whereby the cargo container is capable of withstanding the explosive blast.

In order to accomplish the objectives, a blast-resistant cargo container in accordance with the present invention includes side panels and connecting members. The connecting members are securely mounted between the adjacent side panels to form a flexible structure of the cargo container.

The ductile connecting members are totally different consideration (for example: material, thickness, etc.) with the side panels. During the blast process, they are sufficiently flexible to be stretched and deformed plastically. This causes the stress redistribution gradually such that the bending stress can be minimized near the edges of a cargo container. Such connecting members are introduced in present invention to connect adjacent side panels and can achieve the objective of present invention.

Our connecting members and side panels construction, which is separable in geometry and material, can provide a mechanism to select different characteristic side panels including light weight panels such as composite or metal laminated composite plates.

DETAILED DESCRIPTION OF THE PREFERRED EMBODIMENT

For the purpose to utilize the membrane strength of a material, especially in the edges nearby, of a blast-resistant container we should use the connecting members which are able to transmit tensile forces between every two adjacent side panels and that it can rotate the member itself like a hinge when a blast occurs. The connecting member can be connected to side panels directly or indirectly. Which means that the both ends of connecting member can be connected to both side panels directly or only one end of connecting member is connected to one side panel, the other one end is not directly connected to the other side panel.

Figure 1:
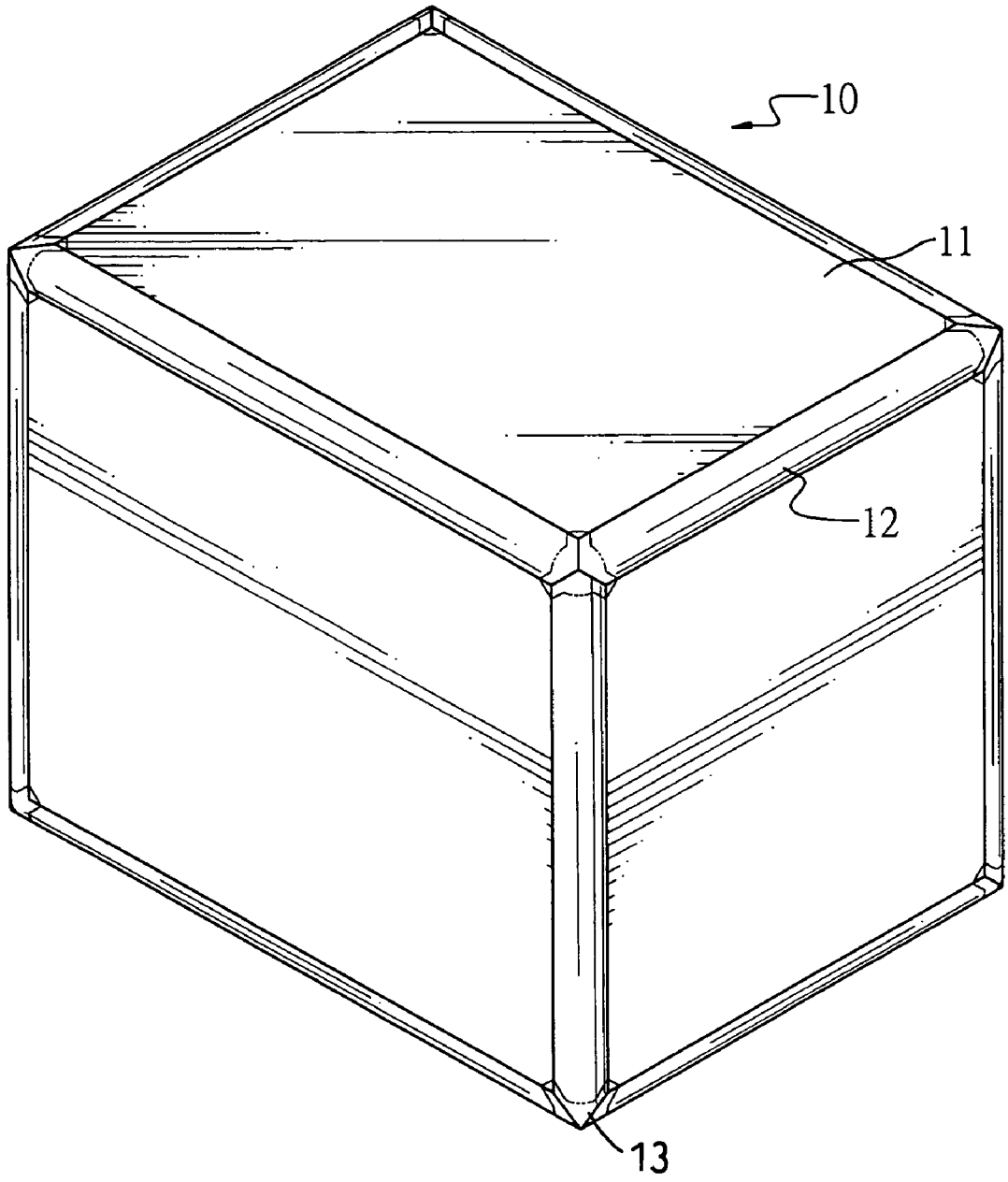
FIG. 1 is a perspective view of the first preferred embodiment of a blast-resistant cargo container in accordance with the present invention.

With reference to FIG. 1, the first preferred embodiment of a blast-resistant cargo container in accordance with the present invention is shown. The cargo container (10) has side panels (11) and plastically stretched connecting members (12) securely connected to adjacent side panels (11), so that a chamber can be formed inside the side panels (11) to receive the goods.

Figure 2:
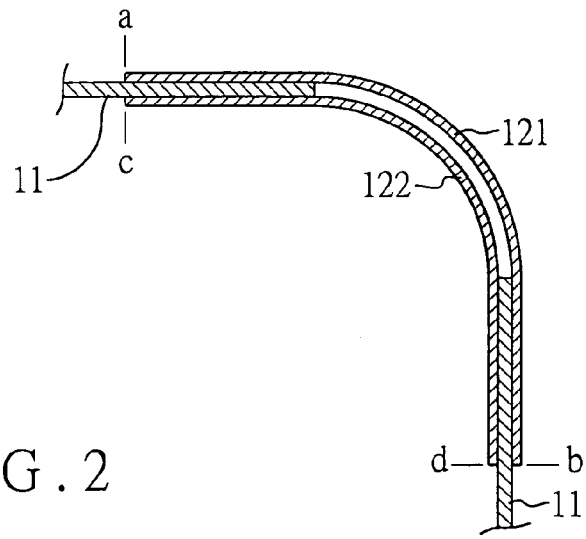
FIGS. 2–7 are cross-sectional views showing different embodiments of connecting members of the blast-resistant cargo container.
Figure 3:
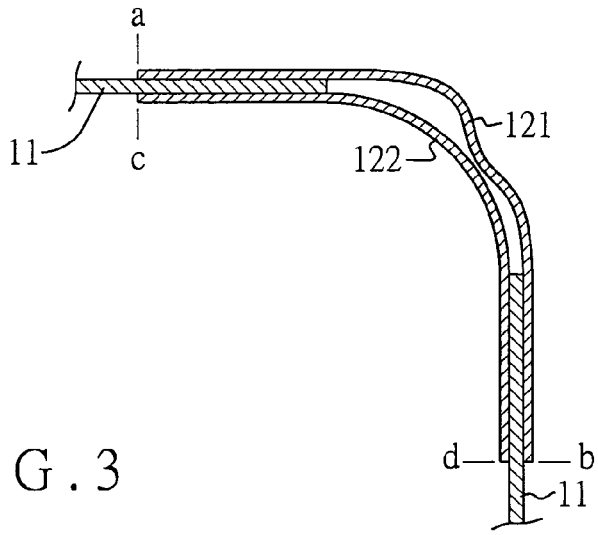
Figure 4:
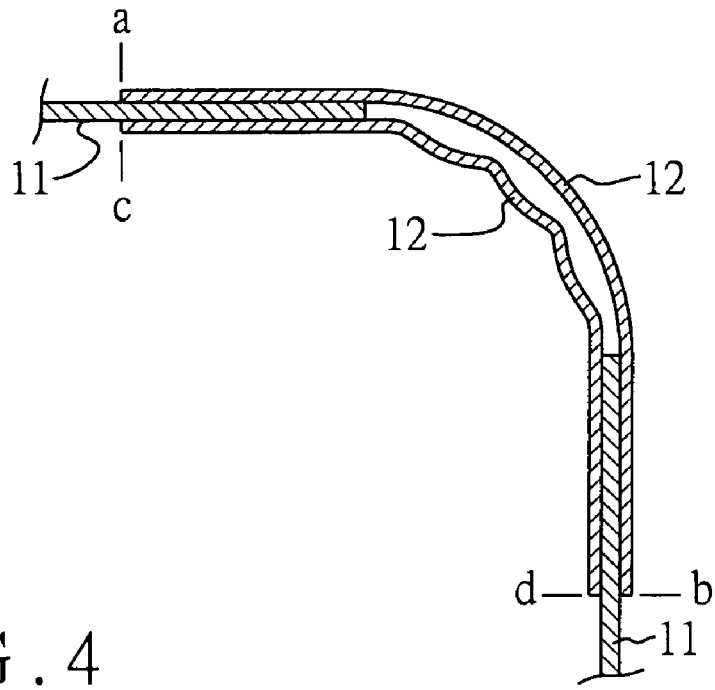
Figure 5:
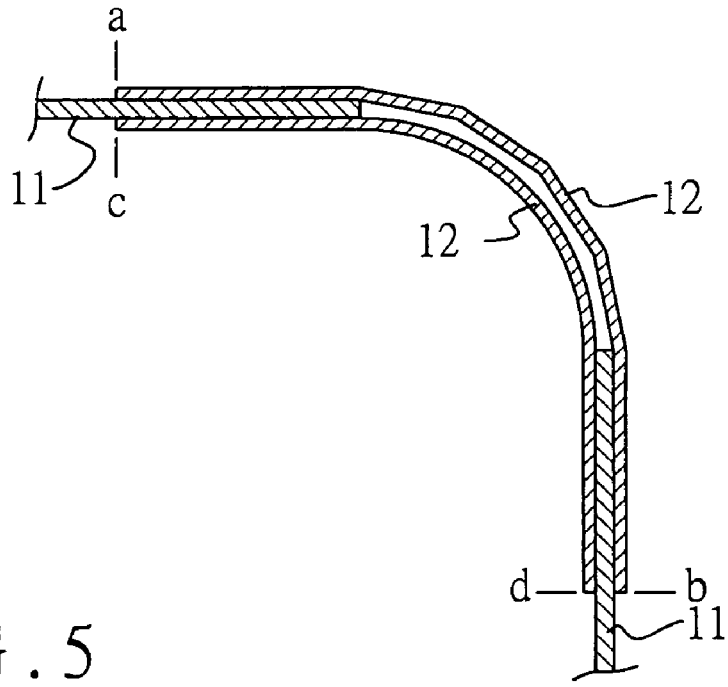
Figure 6:
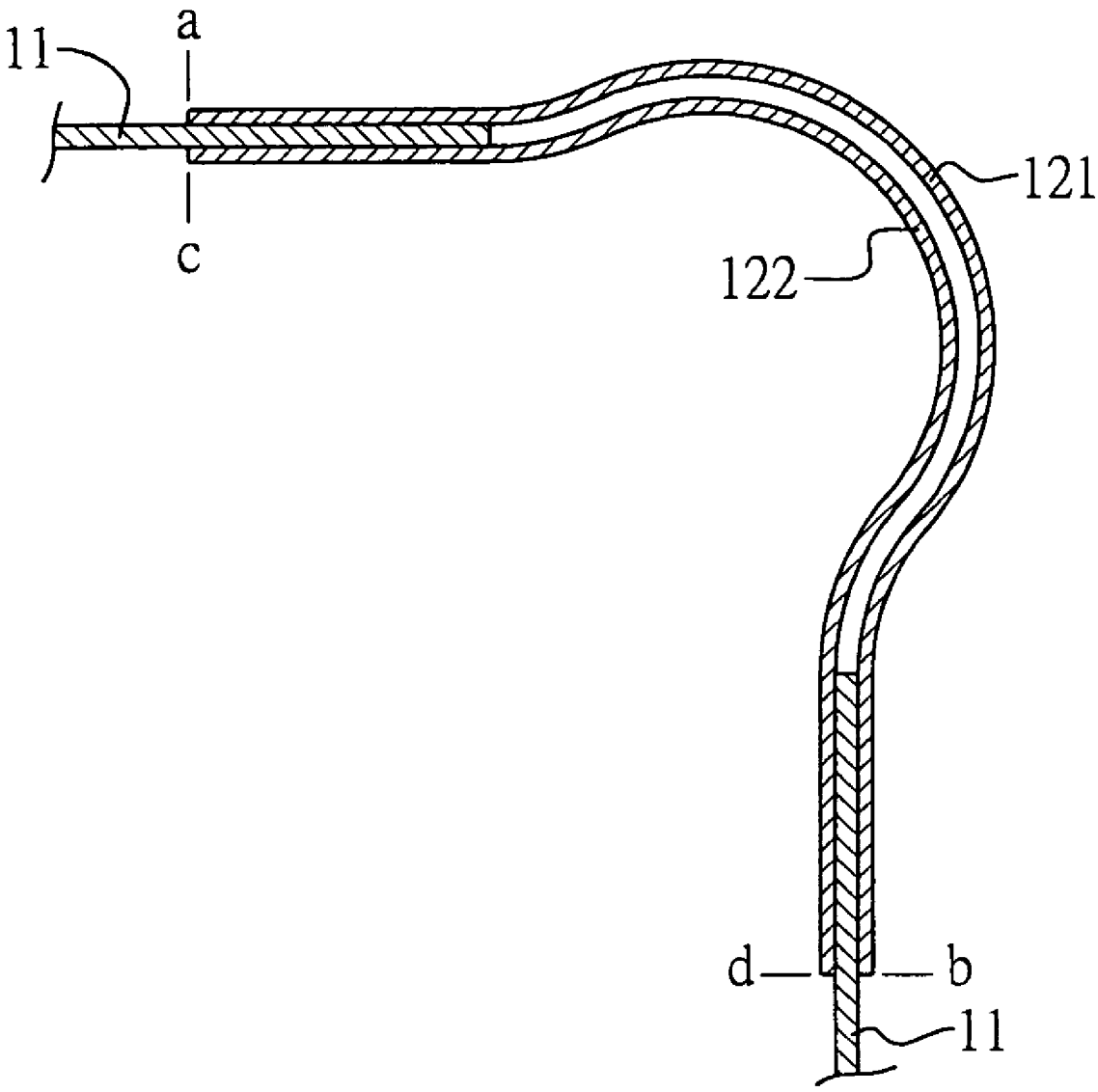

Referring to FIG. 2, the two layer plastically stretched connecting member (12) has an arcuate shape in cross-section, and is composed of an outer and an inner layer connecting members (121,122) respectively connected to outer and inner surfaces of the adjacent side panels (11) with overlap. Referring to FIG. 3, both or either one of the two layer connecting members (121,122) can be adjusted to have a substantial "S-shaped" cross-section. Referring to FIG. 4, one of the two layer connecting members (121,122) can also be varied to have a crinkled cross-section. Referring to FIG. 5, one of the two layer connecting members (121,122) can be further varied to have an arcuate cross-section constituted by line segments. Referring to FIG. 6, the connecting members (12) can be varied to have a "bubble-shaped" cross section.

There are two reasons that we need to adjust the shape of the plastically stretched connecting members (12,121,122): one (referring to FIG. 6) is to increase their stretching flexibility (the curve cross section will be plastically stretched to near a straight cross section under a blast) or to decrease the too great bending stiffness locally such that it can enhance the overall structural strength when blast occurs in the container, and the other one is mainly for adjusting the difference of cross section length (referring to FIG. 2 to FIG. 6, the length from a to b and the length from c to d are cross section lengths of outer and inner layer connecting members respectively) between the outer and the inner layer connecting members (121,122).

Figure 7:
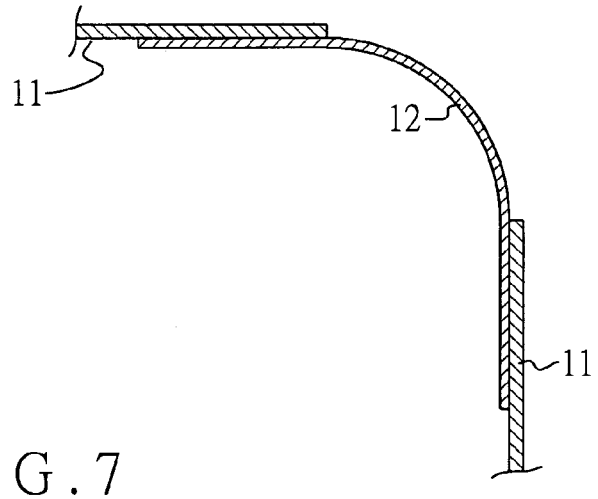

Moreover, referring to FIG. 7, the adjacent side panels (11) can be connected by a single layer plastically stretched connecting member (12) instead of two layer plastically stretched connecting members as previously described.

Figure 8A:
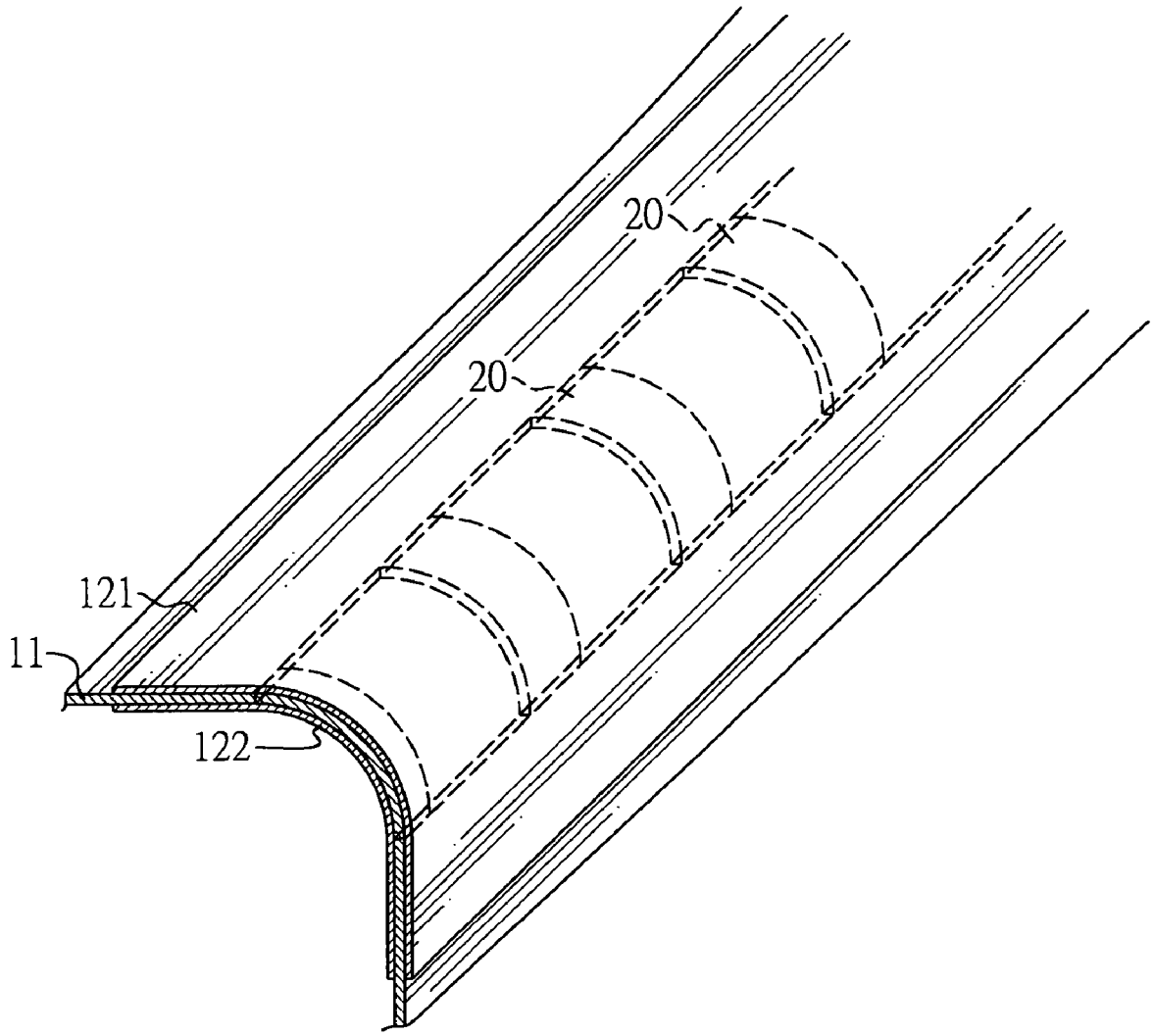
FIG. 8A–8C are schematic views showing different spacers are applied between two layer connecting members for bending stiffness reinforcement.
Figure 8B:
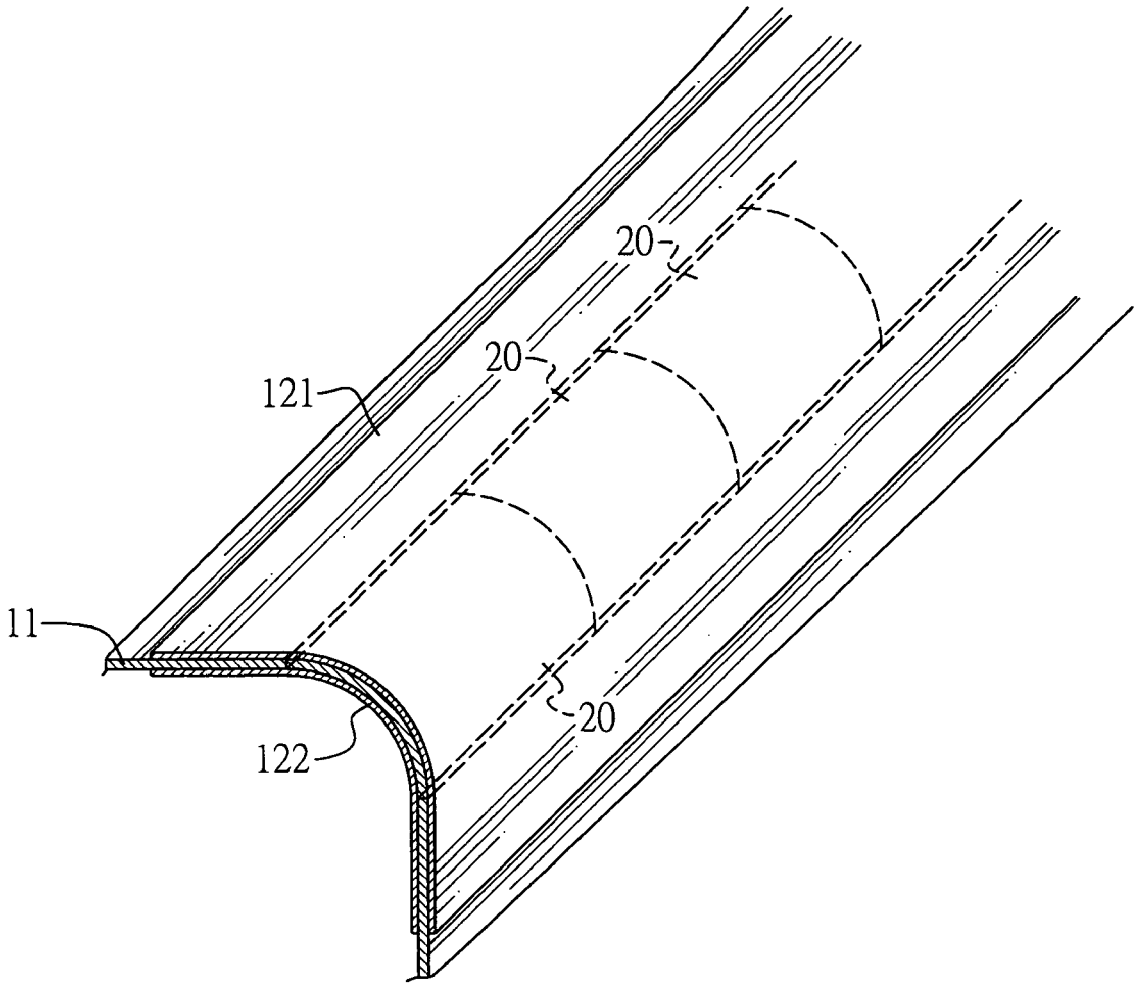
Figure 8C:
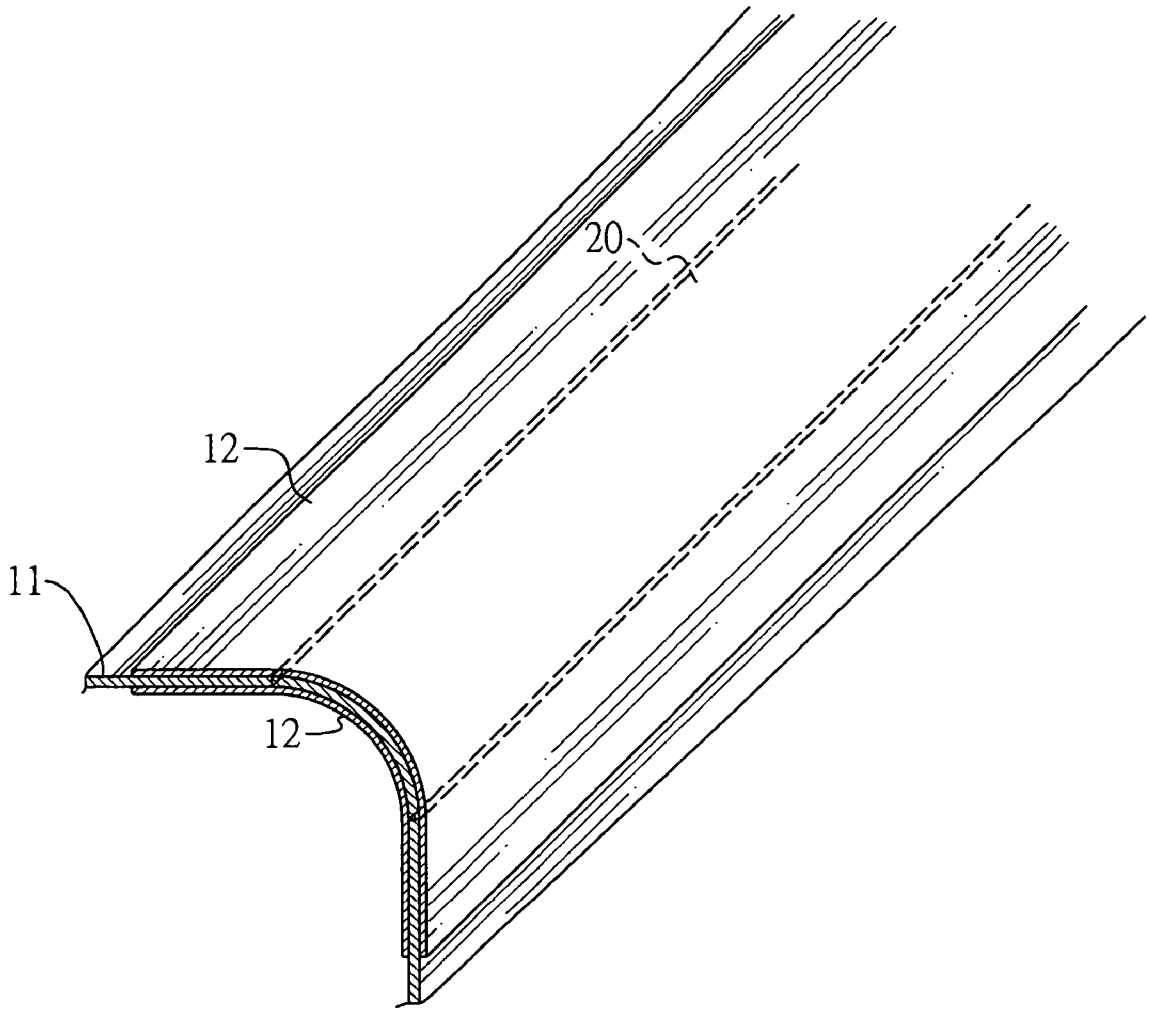

The requirements of the plastically stretched connecting members are not only the stretching flexibility under blast, but also having enough bending stiffness such that the container can be operated to load/unload goods as usual. Referring to FIGS. 8A, 8B and 8C, it is noted that spacers (20) may be applied and securely engaged between the outer and inner layer connecting members (121,122) with continuous spacers or each one of the spacers (20) spatially parted from the others. Those spacers, which can transmit shear stress between outer and inner layer connecting members (121,122) to combine them as a whole one plastically stretched connecting member, are used to reinforce the bending stiffness of the plastically stretched connecting members (12). The materials of the spacers can be low tensile strength and low density materials, such as foam materials. Once the bending stiffness of the two layer connecting member is too little, it can be adjusted by the spacers (20). Referring to FIG. 8A again, the spacers (20) are being spatially parted and the less spacers added, the lesser bending stiffness is increased.

Figure 1A:
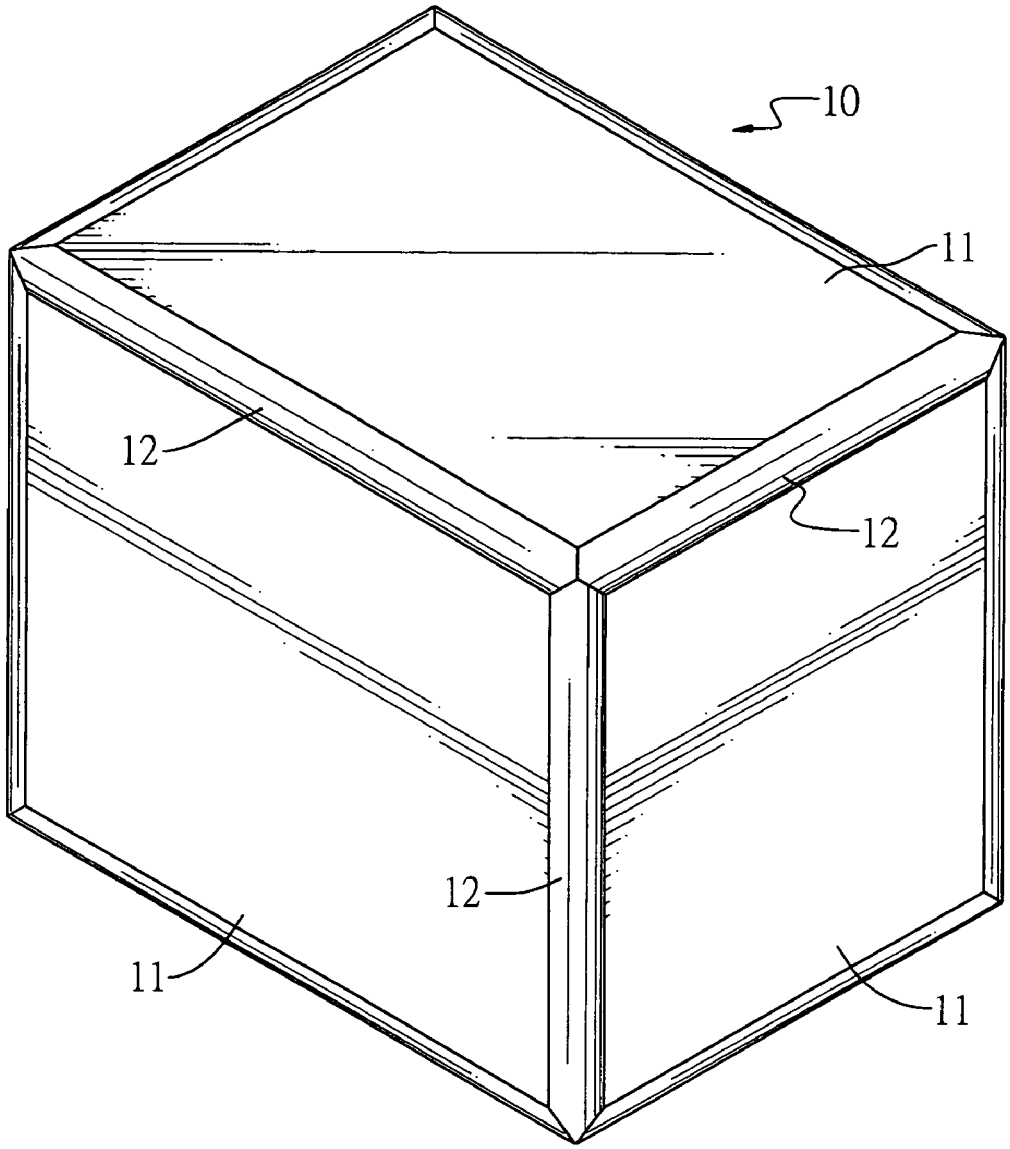
FIG. 1A is a perspective view of a blast-resistant cargo container for the option without the corner caps.

Referring to FIGS. 1 and 1A, the main characteristic of the present invention is that the cargo container (10) applies a frameless design. That also is, at corners where the connecting members (12) intersect, the connecting members (12) are not securely connected. Such that the connecting members (12) can be separated each other when side panels are removed from their surrounding connecting members. Under such an arrangement, the entire structure of the air cargo container of the present invention is not rigid in corners and the stress concentration can be relieved. There are caps (13) respectively optionally disposed onto the corners. The option without the caps, wherein the connecting members are extended as closely as possible at corners, is shown in FIG. 1A. In the optionally disposed caps (13) case, there are larger openings at the corners and the caps can close the openings to avoid water etc. entering in. Each cap (13) is securely connected to one of the side panels (11) only. That is, although the cap (13) is surrounded by three connecting members (12) and three side panels (11), the cap (13) is only securely connected to one of the adjacent three side panels (11). During an explosive blast inside the container, the cap (13) is to be "opened" (referring FIG. 13) by the released airflow in a controlled manner and cannot separated with the container to hurt an aircraft or its carrier furthermore.

Figure 9:
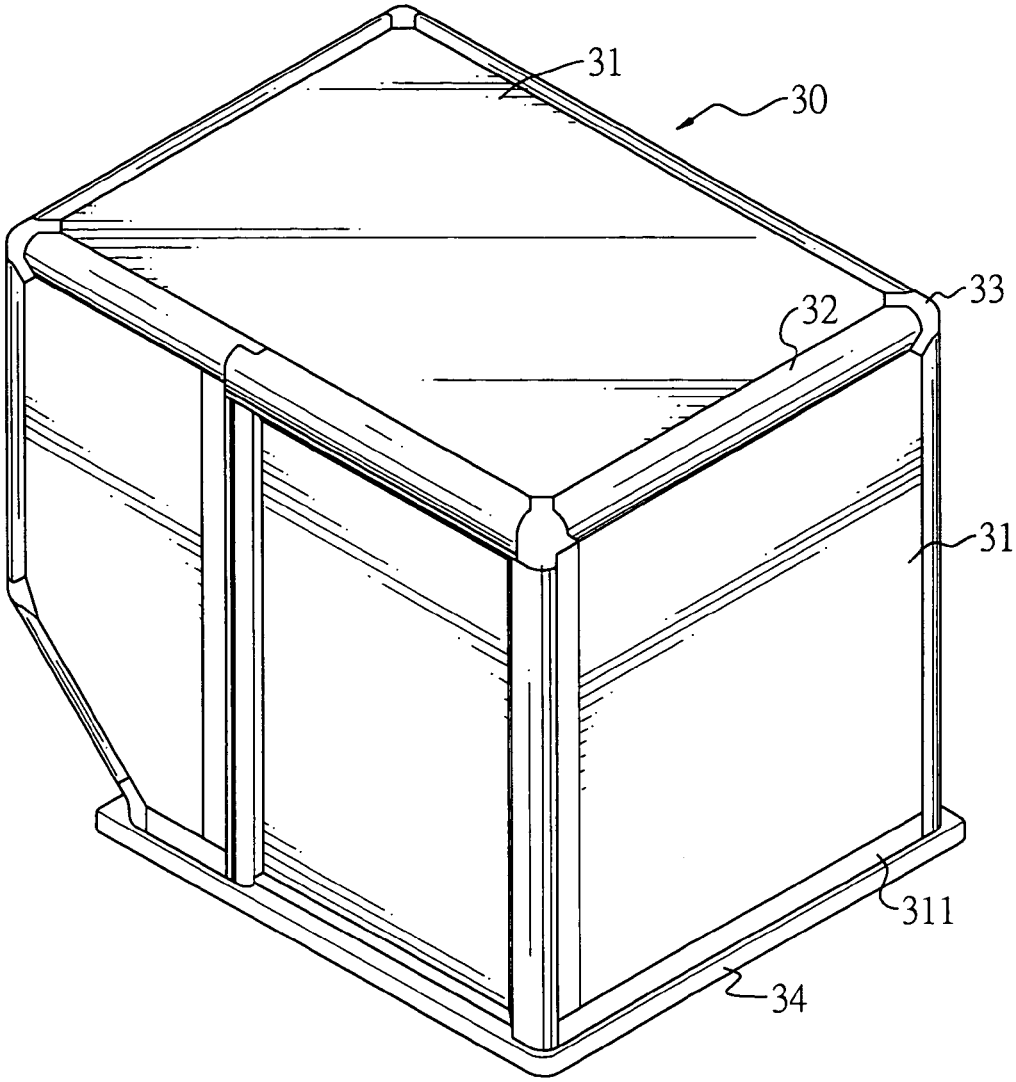
FIG. 9 is a perspective view of the second preferred embodiment of the blast-resistant cargo container.
Figure 10:
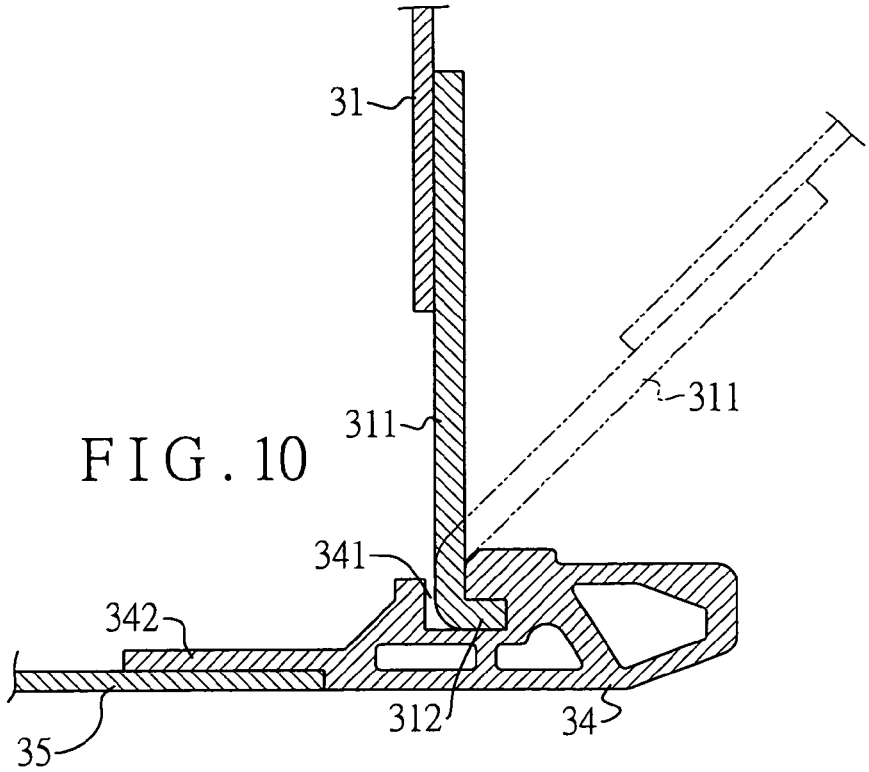
FIGS. 10 and 11 are schematic, cross-sectional views showing a kind of connection between a side panel and a bottom perimeter bar, and deformation after an explosive blast is also shown.

With reference to FIGS. 9 and 10, the second preferred embodiment of the blast-resistant cargo container in accordance with the present invention is shown. The cargo container (30) in this preferred embodiment also includes side panels (31) and plastically stretched connecting members (32) each securely connecting adjacent side panels (31). Especially, multiple perimeter bars (34) are mounted around a bottom panel (35) of the cargo container (30) and securely connected with the bottom panel (35) by an extension (342) of the perimeter bars (34). Perimeter bars (34) are used to prevent separation with the deck during transportation and a demand of transportation association. For example, all air cargo containers have to meet the requirements stetted by NAS (National Aerospace Standard) 3610 Restraint Condition.

With reference to FIG. 10 again, each of the perimeter bars (34) has a groove (341) defined therein. Each perimeter bar (34) is combined with a vertical side panel (31) through a L-shaped connecting member (311). The upper end of the L-shaped connecting member (311) is securely mounted to the vertical side panel (31), and the lower end of this connecting member (311) is formed as a L-shaped flange (312) to be received in the corresponding groove (341). It should be pointed out that when the explosive blast occurs in the cargo container (30), the vertical side panels (31) are displaced outwardly but not detached from the perimeter bars (34) due to the mating between the L-shaped flanges (312) and the grooves (341). It also permits to have a great rotating angle which includes the plastic rotating deformation coming from the upper end of L-shaped connecting member (311) plastically rotating the member itself between the upper end of the L-shaped connecting member (311) and the perimeter bar (34). Such that the L-shaped connecting members (311) are able to transmit tensile forces between the bottom panel (35) and its adjacent side panels (31) through the perimeter bars (34). Therefore, even the vertical side panels (31) relatively rotate to the perimeter bars (34) greatly, the vertical side panels (31) can still take high tensile stress and be avoided the high bending stress.

Figure 11:
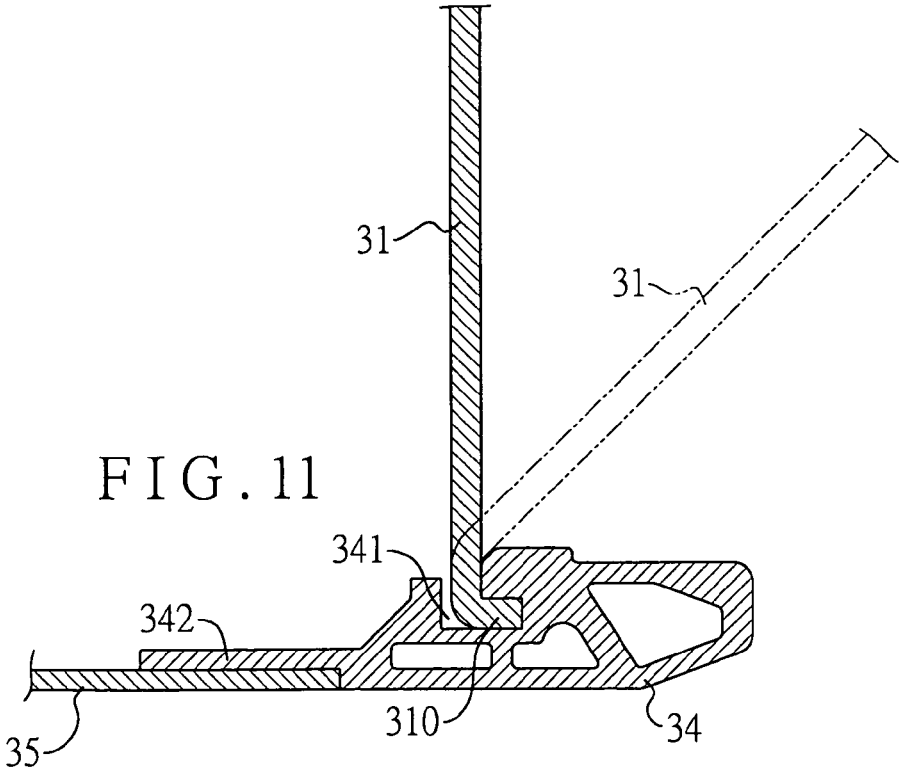

With reference to FIG. 11, each vertical side panel (31) can also have its lower end formed as a L-shaped flange (310) so as to be received in the corresponding groove (341). Therefore, in the explosive blast, as the side panels (31) are directly connected to the perimeter bars (34) so that the side panels (31) are displaced outwardly but not detached from the perimeter bars (34) due to the mating between the flanges (310) and the grooves (341).

The objective of the present invention is to adapt the interaction behavior between the explosive blast and the structure of the air cargo container of the present invention so as to automatically control the plastically stretching deformation of the plastically stretched connecting members (12 or 32) or/and the rotating deformation of L-shaped plastically stretched connecting members (311).

Figure 12A:
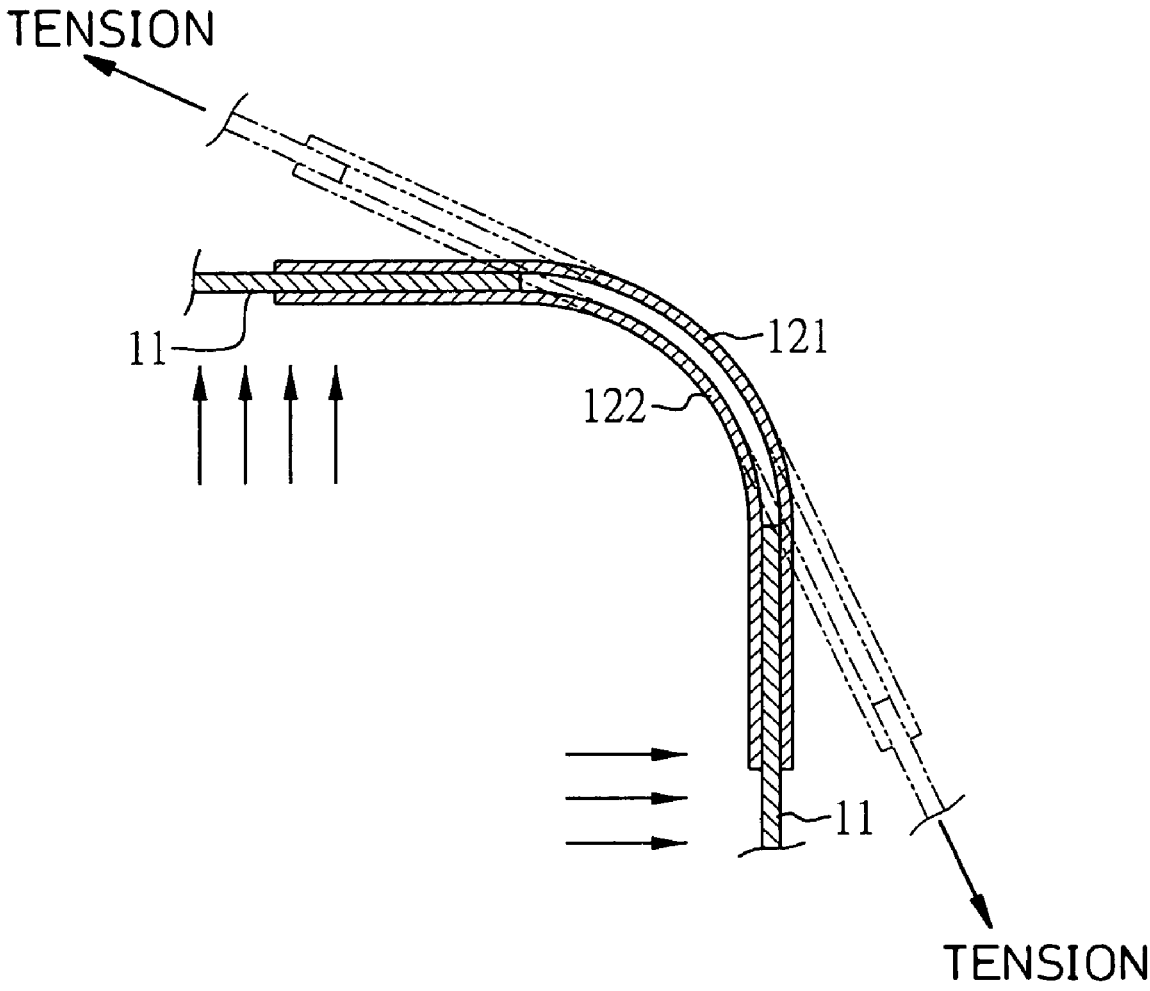
FIGS. 12A and 12B are schematic cross sectional views showing the interaction between the blast and the structure.

FIGS. 12A show the interaction between the blast and the structure overall, wherein the dashed lines show that the plastically stretched connecting member (12 or 32) is stretched to a nearly straight shape from an originally bent shape. The side panels (11 or 31) are expanded outwardly due to the great pressure from the blast. During the expanding process, the bending and shear stresses are generated firstly, then the membrane (tensile) stress generated secondly in the plastically stretched connecting members (12, 32). If the plastically stretched connecting members (12, 32) are flexible enough, their bending stresses will result in mainly elastic (little plastic) deformation accompanied with both ends of the plastically stretched connecting members (12, 32) displaced outwardly (such that both ends of the plastically stretched connecting member is outwardly elastically rotating the member itself) and they will be stretched by the membrane force without further bending failure. Following the stretching process, the plastically stretched connecting members (12, 32) with curve cross section being plastically stretched to near straight cross section gradually, the applying pressure to the structure being taken mainly by the bending stress is changed to mainly by the membrane stress due to the changes of geometrical shape of the whole structure (changed to near a spherical gradually). It also can be regarded as a stress redistribution process. Thus, the bending stress cannot be accumulated during the increasing of structure deformation. Therefore, the entire container structure members (including the connecting members and side panels) almost take pure tensile forces and those bending and shear stresses are minimized. Hence, the overall structure of the cargo container is protected in the meaning of avoiding wasting its ultimate strength of construction material.

Figure 12B:
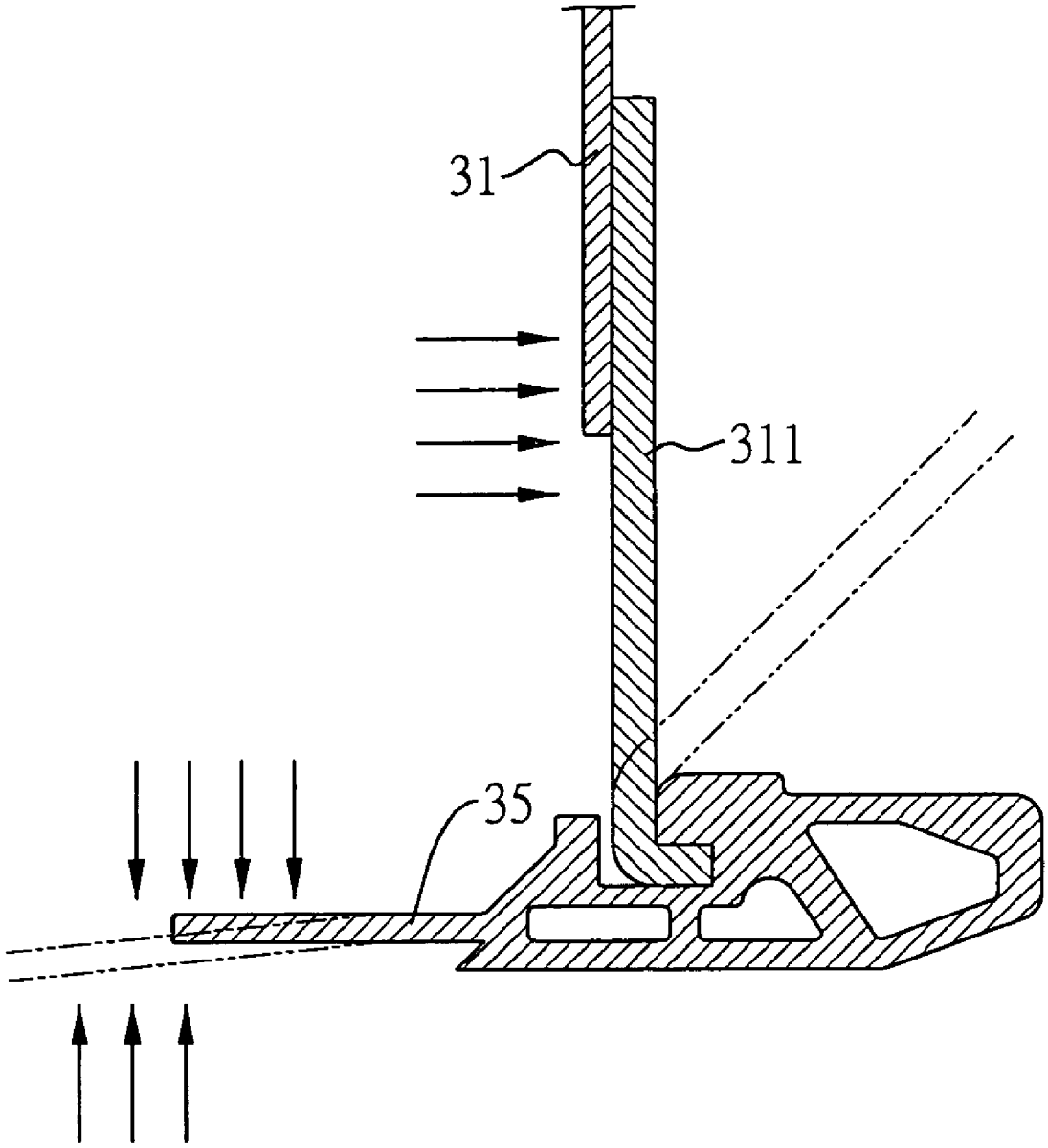

FIGS. 12B show the interaction between the blast and the structure in the bottom perimeter bars (34) nearby. The expansion of bottom panel (35) is little for that perimeter bars (34) are restrained on the deck and the rotation of the vertical side panels (31) near perimeter bars (34) is relative very great under blast loading. The L-shaped connecting members (311) may provide enough flexibility and ductility to transmit forces between bottom panel (35) and its adjacent side panels (31) aptly through bottom perimeter bars (34). The area near bottom perimeter bars (34) of a cargo container is protected, too.

In order to meet the foregoing objectives, the plastically stretched connecting members (12, 32) and the L-shaped connecting member (311) in the described embodiments are preferably made of high ductility materials, i.e. highly allowable strain (elongation strength), such as stainless steel or high ductility aluminum alloy. For that it can take loading under a long-range plastic state without failure until its maximum strain over its elongation strength.

In order to fully utilize the membrane strength of the side panels (11 or 31), it should be careful to avoid excessive bending stress in the side panels (11,31) during the explosive blast. As a consequence of this consideration, the thickness of the side panels (11,31) should be limited. I.e., the span-thickness ratio L: t should be no less than 50 and preferably greater than 200 for side panel (11,31) made of very little ductile material. Where L is the minimum one of the spans between two supports, i.e. the minimum length one of two perpendicular directions in a side panel (11,31) which is no supports except at its surrounding edges. And t is the thickness of side panels (11,31). Such that it will be little bending stress in the side panels (11,31) during the explosive blast. Based on above conditions, the ductile material is not a necessary requirement for side panels (11,31). The side panels (11 or 31) including the bottom panel (35) are preferably made of material with high tensile strength to withstand the great pressure from a blast, such as high strength metal, fiber-reinforced composite, laminated composite or metal laminated composite plate. Furthermore, a high strength, light weight composite or metal laminated composite plate can be selected and thus a light weight blast-resistant container can be constructed.

Further considering the implementation of the foregoing plastically stretched connecting members: Each plastically stretched connecting members (12 or 32) may be manufactured by either sheet-metal bending (including press forming) or extrusion. Both of the two kinds of manufactured members need to consider the maximum strain $\epsilon_{max}$ coming from the difference between the conditions of before blast (the curvature is κ) and after blast (the curvature near zero) and whether it is greater than the material strength of strain. That is, the following equations should be met:

$$\epsilon_{max}=\kappa\times t/2 \quad \epsilon_{max}<\epsilon_c$$

where t is the thickness of the plastically stretched connecting member $\epsilon_c$ is the maximum allowable strain (strength of strain) of the plastically stretched connecting member Therefore, the material damage of the plastically stretched connecting member (12, 32), either coming from manufacture process (from a straight to a curve) of sheet-metal bending or coming from the stretching process (from a curve to a straight) in a blast for the extruding manufacture case, is avoided.

When the plastically stretched connecting member (12, 32) is two layer type configuration as shown in FIG. 12A. Not only the equation listed above should be considered, but the strain of inner connecting member has to be considered also. Referring to FIG. 12A, in order to stretch safely the plastically stretched connecting member (12, 32) outwardly to be straight and fully utilizing both the material strength of the inner and the outer layer connecting members (121 and 122), we should consider whether the ductility of the inner layer connecting member (122) being enough or not additionally. It means that the inner layer member (122) should not be damaged before the outer layer (121) being just stretched to a straight for that the inner layer is stretched ahead the outer layer. That is, the following equations should be met:

$$(l_0-l_i)/l_i<\epsilon_c \text{ (Inner member manufactured by sheet-metal bending)}$$

or $$(l_0-l_i)/l_i+k_it_i/2<\epsilon_c \text{ (Inner member manufactured by extrusion)}$$

where $\epsilon_c$ is the maximum allowable strain $k_i$ is the curvature of the inner layer connecting member (122)

$t_i$ is the thickness of the inner layer connecting member (122)

$l_i$ and $l_0$ are the cross section length or the length of summation of pieces for the inner and the outer layer connecting members; referring to FIG. 2 to FIG. 6, the length from a to b is $l_0$ and the length from c to d is $l_i$. The difference between two equations is for that the inner layer connecting member (122) manufactured by sheet-metal bending case is a strain recovery (decreasing) process when it is stretched from a curve to a straight.

The cargo container (10 or 30) in accordance with the present invention is designed to have sufficient stiffness for loading goods. When the explosive blast occurs in an interior of the cargo container (10 or 30), due to the unique method, a flexible structure is formed and expands to fully utilize membrane stress of the side panels (11 or 31).

Figure 13:
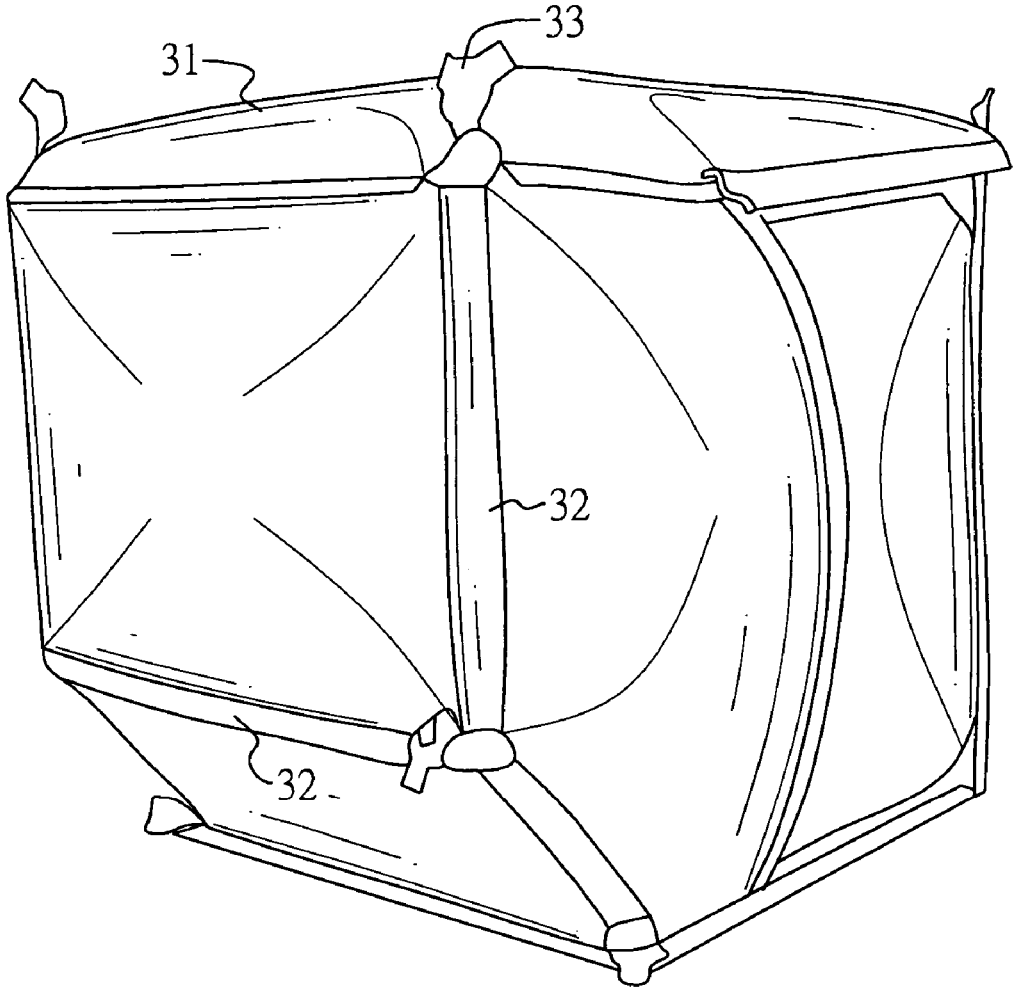
FIG. 13 is a schematic view showing the deformation of the cargo container of the present invention after blast.
Figure 14:
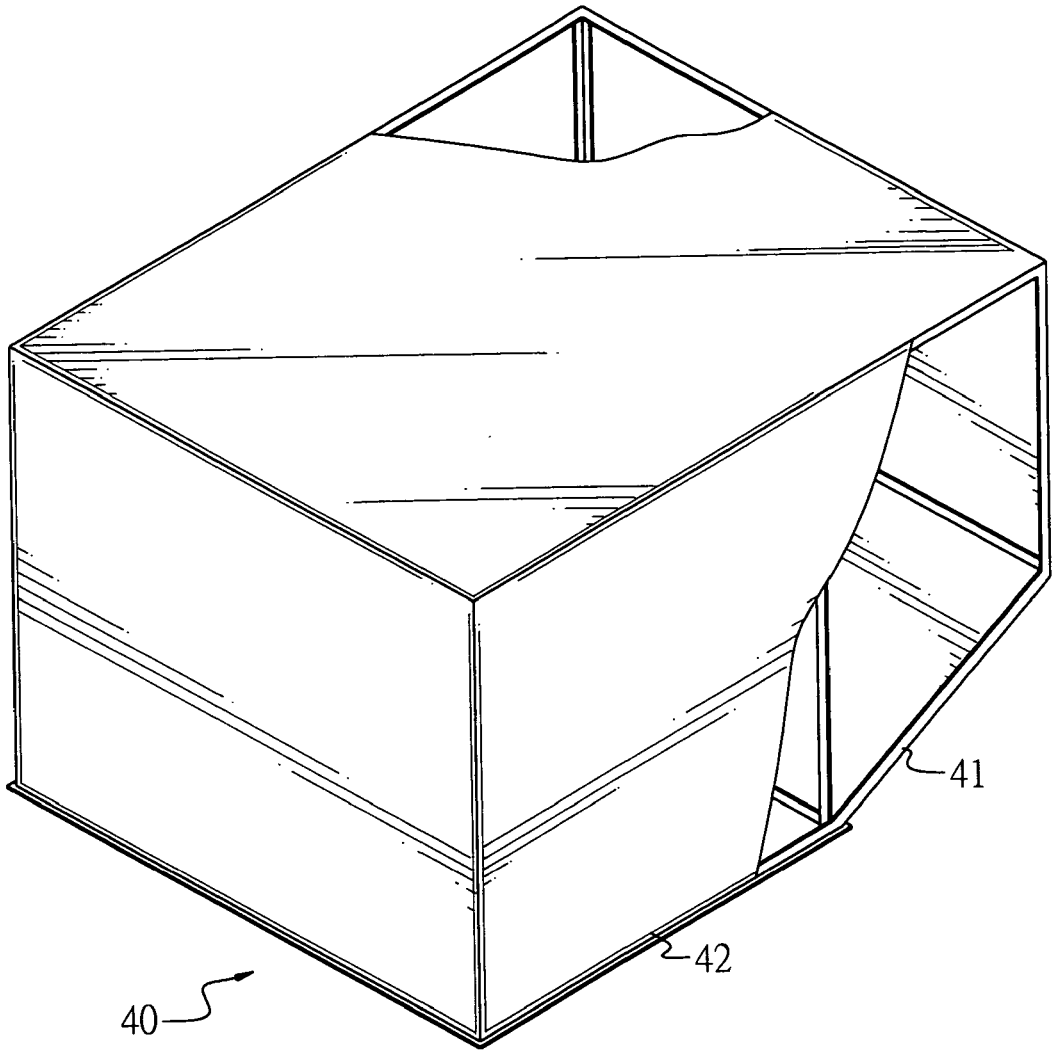
FIG. 14 PRIOR ART
FIG. 14 is perspective view of a conventional air cargo container with partial in section so as to show the structure thereof.

During researches at ITRI in Taiwan, there are several types of LD3-sized air cargo container prototypes in accordance with the present invention were designed and manufactured. Aluminum alloy and aluminum laminated composite were adopted for the side panels. Stainless steel and aluminum alloy are adopted for the plastically stretched (32) and L-shaped connecting members (311). The thickness for both the side panel and the connecting member is between 1 mm~6 mm. High strength bolts are applied to combine the engagement between the connecting members and the side panels. For example, the two main type: one (with corner caps) used aluminum side panels and steel connecting members weighs less than 270 Kg, the other one (without corner caps) used aluminum laminated composite side panels and aluminum connecting members weighs less than 160 Kg. The two layer type connecting members were adopted and none of them were with spacers reinforced. From the result of static test, it is found that the structure design of the container in accordance with the present invention does have the enough stiffness for loading goods therein (according to the loading specified in TSO-C90C). The blast tests of both the conventional air cargo containers (which are in accordance with the FAA regulations) and the present blast-resistant air cargo containers were executed several times. They showed both of our main two prototypes can resist explosive blast successfully and the conventional air cargo containers were failure and its side panels being exploded out far away. It is also found that the container in accordance with the present invention is able to expand as expected and effectively confine the blast mighty power within the container. FIG. 13 shows the expansion of the container when the blast occurs so that the blast power is perfectly confined therein.

In addition, when the blast waves generated in the explosive blast those high density blast "particles" will impact the side panels (11 or 31), the side panels (11 or 31) displace outwardly so that the blast "particles" temporarily separate from the side panels (11 or 31) and impact again afterwards. This process can be considered as a series of non-elastic collisions and the explosive blast energy is absorbed in increments of entropy to reduce the final explosive pressure exerted on the structure of the cargo container (10 or 30). In summary, the structure not only utilizes the membrane stress to withstand the explosive blast, but also appropriately expands to reduce the final pressure that the whole container structure must take.

From the above description, it is noted that the invention has the following advantages:

1. The cargo container is constructed by connection of side panels and the absence of a conventional frame. This enables the structure to be more flexible. In the explosive blast, the side panels can bear force uniformly to utilize the membrane stress and prevent bending stress near its edges. Therefore, the cargo container can be light in weight while still be capable of confirming the explosive blast therein.

2. The mating between the flanges and the grooves in the bottom surface is not only convenient to assemble, but also is more flexible to allow a large deformation rotating angle between vertical side panels and bottom panel so as to withstand the explosive blast.

3. The plastically stretched connecting members can be easily adapted to connect side panels having different thickness and/or made of different materials. Therefore, the assembly of the cargo container is convenient and it also provides a mechanism to select different side panels with different characteristics for practical needs.

While this invention has been particularly shown and described with references to the preferred embodiment thereof, it will be understood by those skilled in the art that various changes in form and details may be made therein without departing from the scope of the invention encompassed by the appended claims.

What is claimed is:

1. A blast-resistant cargo container comprising:

multiple side panels which are able to be assembled to form a chamber of the container, at least one of said panels is of high tensile strength, at least one of said panels whose span thickness ratio is greater than a ratio of 50 to 1; and multiple connecting members which are able to transmit tensile forces directly or indirectly between every two adjacent side panels when a blast occurs, said connecting members comprising at least one plastically stretched connecting member with curve cross section which is securely mounted between two adjacent said side panels and is able to be plastically stretched to near a straight cross section under a blast, whereby the structure formed by said side panels and said connecting members has sufficient stiffness for normal operations and is a flexible structure deformed to near a sphere to confine an explosive blast in the structure under a blast.

2. The blast-resistant cargo container as claimed in claim 1, wherein the connecting members which intersect at a corner of the container are not securely connected to each other such that the stress concentration in the corner is able to be relieved.

3. The blast-resistant cargo container as claimed in claim 1, wherein the at least one plastically stretched connecting members is either two layer or single layer connecting member and connected to said adjacent side panels with overlap.

4. The blast-resistant cargo container as claimed in claim 3, wherein at least one layer of said two layer connecting member has an arcuate cross-section comprising a plurality of straight segments.

5. The blast-resistant cargo container as claimed in claim 3, wherein at least one layer of the two layer connecting member has a crinkled cross-section.

6. The blast-resistant cargo container as claimed in claim 3, wherein at least one spacer is disposed between the two layers of said two layer connecting member in order to reinforce bending stiffness of said two layer connecting member when the cargo container is too flexible to be operated as normal.

7. The blast-resistant cargo container as claimed in claim 1, wherein the at least one plastically stretched connecting member has a bubble shaped cross-section.

8. The blast-resistant cargo container as claimed in claim 1, wherein a cap is mounted at each corner of the container and securely connected to only one surrounding side panel.

9. The blast-resistant cargo container as claimed in claim 1, wherein said plastically stretched connecting member is made of a ductile material.

10. The blast-resistant cargo container as claimed in claim 9, wherein the ductile material of the at least one plastically stretched connecting member is selected from the group of metals consisting of stainless steel and high ductility aluminum alloy.

11. The blast-resistant cargo container as claimed in claim 1, wherein at least one of said side panels of high tensile strength is selected from a group of plates consisting of fiber-reinforced composite, laminated composite, metal laminated composite and high strength aluminum alloy plates.

12. The blast-resistant cargo container as claimed in claim 1, wherein the plastically stretched connecting member is manufactured by either sheet metal bending or extrusion.

13. The blast-resistant cargo container as claimed in claim 1, wherein span-thickness ratios of said side panels are greater than a ratio of 200 to 1 for the side panels being made of a material having a ductile feature with a ductility much less than that of the at least one plastically stretched connecting member.

14. A blast-resistant cargo container comprising:

multiple side panels which include a bottom panel and are able to be assembled to form a chamber of the container, at least one of said panels is of high tensile strength, at least one of said side panels whose span-thickness ratio is greater than a ratio of 50 to 1;

at least one perimeter bar which is securely mounted around said bottom panel and has a groove defined therein;

multiple connecting members which are able to transmit tensile forces directly or indirectly between every two adjacent side panels when a blast occurs;

wherein said multiple connecting members comprise at least one plastically stretched connecting member with curve cross section which is securely mounted between two adjacent said side panels and is able to be plastically stretched to near a straight cross section under a blast; and at least one L-shaped connecting member which has a lower end formed as a L-shaped flange to be received in said groove of said perimeter bar and is securely mounted to the adjacent side panel of said bottom panel on an upper end of said L-shaped connecting member, wherein the upper end of said L-shaped connecting members is able to rotate to said perimeter bar greatly under a blast such that the L-shaped connecting member is able to transmit tensile force between said bottom panel and said adjacent side panels through said perimeter bar when a blast occurs, whereby the structure formed by said side panels and said connecting members has sufficient stiffness for normal operations and is a flexible structure deformed to near a sphere to confine an explosive blast in the structure under a blast.

15. The blast-resistant cargo container as claimed in claim 14, wherein said at least one perimeter bar is an extruded bar.

16. The blast-resistant cargo container as claimed in claim 14, wherein at least one of said side panels of high tensile strength is selected from a group of plates consisting of fiber-reinforced composite, laminated composite, metal laminated composite and high strength aluminum alloy plates.

17. The blast-resistant cargo container as claimed in claim 14, wherein the plastically stretched connecting member and L-shaped connecting member are made of ductile materials.

18. The blast-resistance cargo container as claimed in claim 17, wherein the ductile materials of the plastically stretched connecting member are selected from the group of metals consisting of stainless steel and high ductility aluminum alloy.

19. The blast-resistant cargo container as claimed in claim 14, wherein a cap is mounted at each corner of the container and securely connected to only one surrounding side panel.

* * * * *